US008042760B2

(12) United States Patent
Matos et al.

(10) Patent No.: US 8,042,760 B2
(45) Date of Patent: Oct. 25, 2011

(54) METHOD AND APPARATUS FOR TRANSFERRING A WOUND WEB

(75) Inventors: Claudio Antonio Matos, Loveland, OH (US); Stephan Otto Hiltenkamp, Belleville (CA); Christopher van de Vrande, Kingston (CA); Rajesh Kumar Singh, Maineville, OH (US)

(73) Assignee: The Procter and Gamble Company, Cincinnati, OH (US)

( * ) Notice: Subject to any disclaimer, the term of this patent is extended or adjusted under 35 U.S.C. 154(b) by 206 days.

(21) Appl. No.: 12/405,539

(22) Filed: Mar. 17, 2009

(65) Prior Publication Data

US 2010/0237180 A1 Sep. 23, 2010

(51) Int. Cl.
*B65H 19/22* (2006.01)

(52) U.S. Cl. ..... 242/533; 242/533.7; 242/559; 242/559.3

(58) Field of Classification Search ..... 242/533, 242/533.7, 559, 559.3–559.4
See application file for complete search history.

(56) References Cited

U.S. PATENT DOCUMENTS 3,718,302 A * 2/1973 Mount et al. ..... 242/533.3
5,205,505 A * 4/1993 Focke et al. ..... 242/559.3
6,260,787 B1 * 7/2001 Michel et al. ..... 242/530.4
6,722,605 B2 4/2004 Joutsjoki
7,380,745 B2 * 6/2008 Narita et al. ..... 242/530.1
7,546,971 B2 6/2009 Pappas
7,674,086 B2 3/2010 Schmidt-Hebbel et al.
7,819,356 B2 * 10/2010 Takatsuka et al. ..... 242/559.3

FOREIGN PATENT DOCUMENTS

EP 1 092 667 B1 4/2001

OTHER PUBLICATIONS

U.S. Appl. No. 12/188,492, filed Aug. 8, 2008, Hammons et al.
U.S. Appl. No. 12/188,527, filed Aug. 8, 2008, Hammons et al.
U.S. Appl. No. 12/188,598, filed Aug. 8, 2008, Hammons et al.
U.S. Appl. No. 12/470,945, filed May 22, 2009, Turner et al.
PCT Search Report, International App. No. PCT/US2010/027626, mail date Jun. 28, 2010, 12 pages.

* cited by examiner

*Primary Examiner* — Sang Kim
(74) *Attorney, Agent, or Firm* — Megan C. Hymore; James E. Oehlenschlager

(57) ABSTRACT

A method and apparatus for transferring a web wound about a loaded core. The steps include providing a core shaft axially extending between a core shaft first end and a core shaft second end, providing a web wound about a loaded core, the loaded core coaxially related to the core shaft, axially supporting the core shaft by a first axial support operatively engaged with the core shaft first end and a second axial support operatively engaged with the core shaft second end, axially moving the loaded core from the core shaft to the second axial support, and removing the first axial support and the second axial support.

13 Claims, 13 Drawing Sheets

METHOD AND APPARATUS FOR TRANSFERRING A WOUND WEB

FIELD OF THE INVENTION

A method and apparatus for transferring a web wound about a loaded core.

BACKGROUND OF THE INVENTION

Webs of materials are commonly produced on production lines in which the end step of the production line is to wrap the web of material onto a core in a winding operation. The core can be supported by a core shaft that is rotatably mounted at the end of the production line. An example of such a web of material wound on a core tube can be thought of as being much like the way in which a web of paper towel material or toilet paper is wound on a cardboard core.

In producing webs of materials in commercial quantities, the mass of web wound on a core can greatly exceed the mass that manufacturing line workers can handle easily. For instance, webs can have a width of several meters and tens of meters of material can be wound about a core. If the web material is something of the nature of household carpet or field turf, the mass can be over one-thousand kilograms. Even for webs commonly thought of as being lightweight materials, such as paper, toilet paper, paper towel material, or absorbent webs for sanitary articles, the mass of the web wound on the core at the end of a production line can exceed one-hundred kilograms.

On a production line, once the desired quantity of the web of material is wound on the core, the web material is cut from web of material upstream of the winding operation. The core shaft, which supports the core, can be moved to a position in which the wound core can be removed from the production line and taken to another production line in which the web of material is integrated into another product, altered further towards the ultimate commercial embodiment, or prepared for storage and/or shipping. Then the core shaft is removed from within the core or the core is removed from the core shaft and the core shaft is moved to a position in which the core shaft can be used again to support another empty core that is subsequently wound with a web.

One approach for removing a core shaft is to support the core shaft, core, and web of material by supporting the web of material by the outer plies whereby the mass of the web is relieved from resting on the core shaft and the core shaft and core can relatively easily slide with respect to one another. For sensitive materials, such as tissue webs and thin porous foams, stress applied to the outer plies of the web wound on the core to relieve the stress between the core shaft and core can damage the web material. Furthermore, applying stress axially to the web to force the web and core to slide off of the core shaft can damage the web of material.

One approach to removing the core shaft from a loaded core without stressing the web material is to support the loaded core shaft at each end of the core shaft, connect an axial support to one end of the core shaft, remove the support at the end of the core shaft proximal the axial support, slide the loaded core onto the axial support, replace the support at the end of the core shaft proximal the axial support, separate the axial support from the core shaft, connect an axial support loaded with an empty core to one end of the core shaft, remove the support at the end of the core shaft proximal the axial support, slide the core onto the core shaft, replace the support at the end of the core shaft proximal the axial support, and moving the core shaft and empty core from the supports into a position in which the core shaft can be used again to support another empty core that is subsequently wound with a web. One drawback to such an approach is that many steps of supporting and removing support from the core shaft are required, thus increasing the time required to remove a core shaft from a loaded core and increasing the possibility of the loaded core falling, thereby damaging the web material.

With these limitations in mind, there is a continuing unaddressed need for a method for removing a core shaft from a loaded core in a simple and time-efficient manner that will not damage web material. There is a further continuing unaddressed need for a method for removing a core shaft from a loaded core that provides for a simple process for providing a fresh core on core shaft.

SUMMARY OF THE INVENTION

A method for transferring a web wound about a loaded core comprising the steps of providing a core shaft axially extending between a core shaft first end and a core shaft second end, providing a first web wound about a loaded first core, the loaded first core coaxially related to the core shaft, axially supporting the core shaft by a first axial support operatively engaged with the core shaft first end and a second axial support operatively engaged with the core shaft second end, axially moving the loaded first core from the core shaft to the second axial support, and removing the first axial support and the second axial support.

An apparatus comprising a core shaft axially extending between a core shaft first end and a core shaft second end, a first axial support operatively engaged with the core shaft first end, a second axial support operatively engaged with the core shaft second end, the first axial support sized and dimensioned to support an empty core coaxially related to the first axial support, the second axial support sized and dimensioned to receive a loaded first core coaxially thereon.

DETAILED DESCRIPTION OF THE INVENTION

Figure 1:
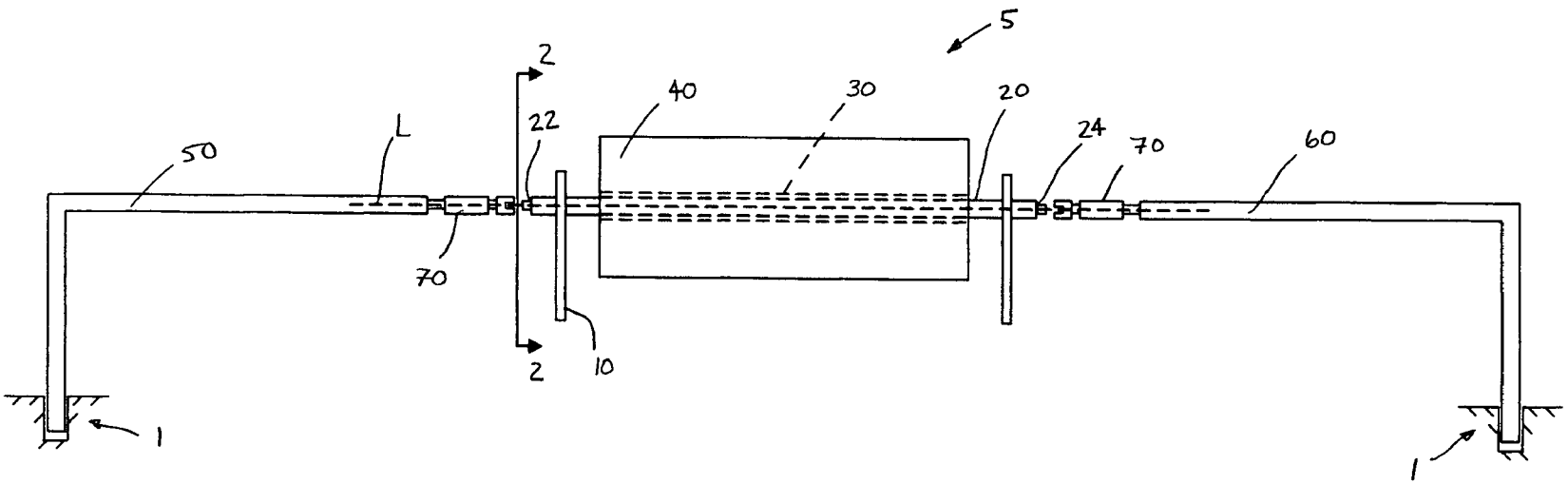
FIG. 1 is a schematic front-view of an embodiment of a roll transfer apparatus.

An illustration of one embodiment of a roll transfer apparatus 5 is shown in FIG. 1. As shown in FIG. 1, a first web 40 of material can be wound onto a first core 30. The first web 40 can be a material such as soft tissue, a thin porous foam, field turf, carpet, paper towel, or other such material that is commonly produced in a wide width web. The first core 30 can be a hollow tube of material such as cardboard, plastic, or like material that is strong enough to adequately support the first web 40. For instance, the first core 30 can be a spiral wound cardboard tube like that commonly employed to support household rolls of paper towels, the core first 30 having an adequate strength to support the web and perform satisfactorily in the winding process and subsequently unwinding.

The first web 40 wound onto the first core 30 can be supported by a core shaft 20. The core shaft 20 can be a material such as metal or plastic having a sufficient bending stiffness to support the first web 40 of material wound onto the first core 30. The first core 30 can be axially engaged with the core shaft 20. That is, the core shaft 20 can reside within the first core 30 and be coaxially related to the first core 30 such that the longitudinal axis L of the core shaft 20 and first core 30 are approximately coincident with one another.

A core shaft 20 and first core 30 can be placed at the end of a production line that produces a first web 40 of material. Once a suitable quantity of first web 40 is wound on the first core 30, the first web 40 can be separated, for instance by cutting, from the production line, which leaves a first web 40 wound about a first core 30, the first core 30 being supported by core shaft 20. In this configuration, the first core 30 can be described as being a loaded first core 30. That is, the first core 30 is loaded with the first web 40 wound about the first core 30 such that the core can be described as being a loaded first core 30.

The core shaft 20 can be supported by arms 10. Arms 10 can support the core shaft 20 proximal to the core shaft first end 22 and the core shaft second end 24. The core shaft 20 extends axially between the core shaft first end 22 and the core shaft second end 24. Arms 10 can move the core shaft 20, first core 30, and first web 40 wound thereon, away from the end of the production line. Arms 10 can be made of structural steel and can be part of another machine that carries the core shaft 20 and materials carried thereon from the end of the production line to the roll transfer apparatus 5.

Once arms 10 carry the core shaft 20 into position for transferring the first core 30 and first web 40 wound about the first core 30 into position for separating the core shaft 20 from the first core 30, first axial support 50, second axial support 60, and core shaft 20 can be positioned relative to one another such that first axial support 50 is operatively engaged with the core shaft first end 22 and the second axial support 60 is operatively engaged with the core shaft second end 24, so that first axial support 50 and second axial support 60 can support the entire weight of the core shaft 20 and any materials carried thereon. Each of the first axial support 50 and the second axial support 60 can be supported by a base 1. The first axial support 50 and second axial support 60 can be made of structural steel or other such suitably strong material. One or more presence sensing devices can be affixed to ends of the first axial support 50, second axial support 60, core shaft first end 22, and/or core shaft second end that can detect if the first axial support 50, second axial support 60, and core shaft 20 are properly engaged with one another. The presence sensing device can be a pressure sensing device with an indicator, a button switch and indicator, or like device that can sense and signal the presence of an object.

Bases 1 can be any of a number of structures including holes, for instance cylindrical holes, in the floor of the manufacturing facility in which the first axial support 50 and second axial support 60 which are sized and dimensioned and positioned to receive and structurally support the respective axial support. Bases 1 can be a movable trolley, hand cart, or motorized cart sized and dimensioned to receive, retain, and support the respective axial support. Bases 1 can be structures anchored to the floor of the manufacturing facility. For instance bases 1 can be structures anchored to the plane of the floor of the manufacturing facility and configured to be rotatable with respect to the floor of the manufacturing facility and can be configured to be movable in translation in a direction parallel to the longitudinal axis L of the core shaft 20.

Once the core shaft 20 is supported by the first axial support 50 and the second axial support 60, the arms 10 can be retracted or moved away from the core shaft 20 to a position that will not interfere with removing the loaded first core 30 around which first web 40 is wound and loading of an empty first core 30 onto the core shaft 20.

In one embodiment, first axial support 50 and second axial support 60 can be moved into position to axially support the core shaft 20. One or more coupling units 70 can be provided to facilitate connecting the first axial support 50 to the core shaft first end 22 and connecting the second axial support 60 to the core shaft second end 24. A coupling unit 70 can be part of the first axial support 50, part of the second axial support 60, part of the core shaft 20, or an independent part. For instance, a coupling unit 70 can be operatively positioned to attach the core shaft first end 22 to first axial support 50 and/or a coupling unit 70 can be operatively positioned to attach the core shaft second end 24 to the second axial support 60. A coupling unit 70 can be sized, dimensioned, and operatively positioned to move an axial support, such as first axial support 50 and/or second axial support 60, into engagement with the core shaft 20. A coupling unit 70 can be axially expandable. For instance, a coupling unit 70 can be axially expandable such that the length of the coupling unit can be increased, or decreased, fit between a core shaft end (e.g. core shaft first end 22 and/or core shaft second end 24) and axial support (e.g. first axial support 50 and/or second axial support 60) and operatively engaged with the corresponding axial support (first axial support 50 and/or second axial support 60). Axial expansion of the coupling unit 70 can be provided by, for example, a threaded rod that is operatively engaged with the coupling unit 70 to provide for expansion.

A coupling unit 70 can be attached to either or both of the core shaft first end 22 or the core shaft second end 24 such that the means by which a coupling unit 70 can be attached to either or both of the core shaft first end 22 or the core shaft second end 24 can resist a tensile force applied to the coupling unit 70 along the longitudinal axis L of the core shaft 20. A coupling unit 70 can be attached to either or both of the first axial support 50 or second axial support 60 such that the means by which a coupling unit 70 can be attached to either or both of the first axial support 50 or second axial support 60 and can resist a tensile force applied to the coupling unit 70 along the longitudinal axis the axial support to which it is attached. The coupling unit 70 can be axially expandable such that when the coupling unit 70 is engaged with the core shaft 20 and the respective axial support, the coupling unit 70 is in compression. The coupling unit 70 can be screwed into the end of the axial support (e.g. first axial support 50 and/or second axial support 60) such that the coupling unit 70 can be brought into engagement with the core shaft 20 by unscrewing the coupling unit 70.

A portion of the first axial support 50 or second axial support 60 can be nested in a coaxial relationship with the core shaft 20. That is, in one arrangement, a portion of the first axial support 50 or second axial support 60 can be within the corresponding core shaft first end 22 or core shaft second end 24. In another arrangement, a portion of the core shaft first end 22 or core shaft second end 24 can be nested within the corresponding first axial support 50 or second axial support 60.

Figure 2:
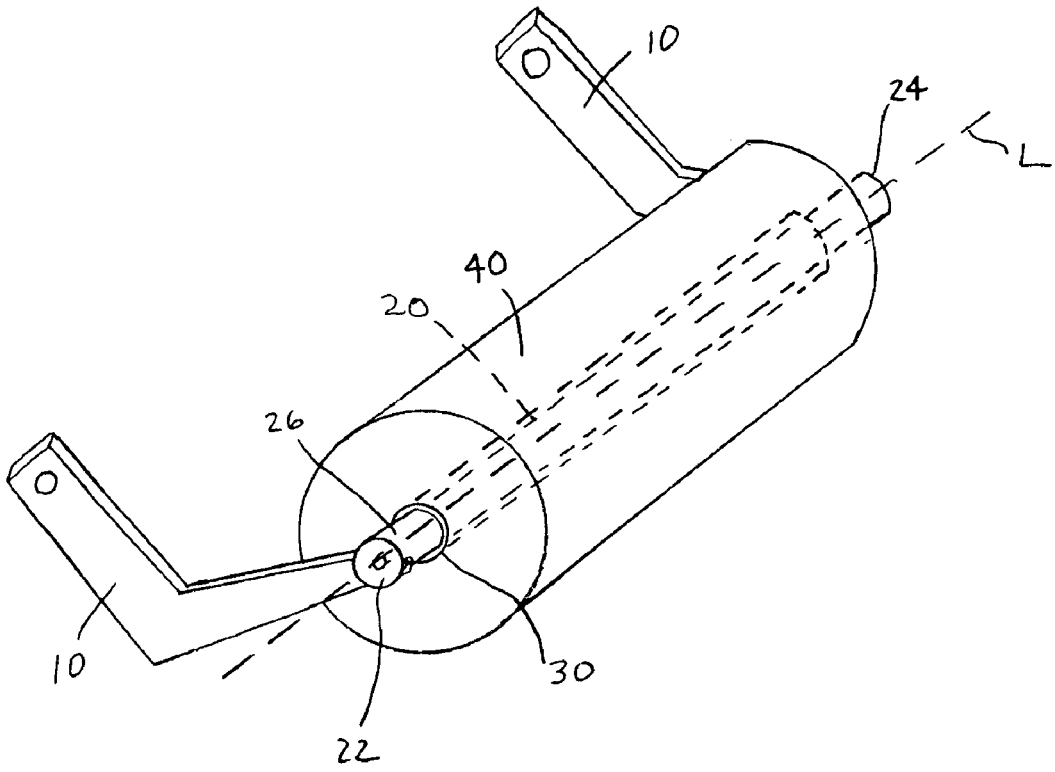
FIG. 2 is a schematic side-view of an embodiment of lowering arms supporting a core shaft, core, and first web wound thereon.

As shown in FIG. 2, the arms 10 can support the core shaft 20 proximal the core shaft first end 22 and core shaft second end 24. The core shaft 20 can have a core shaft perimeter 26. The core shaft perimeter 26 can be measured about the outer surface of the core shaft 20 orthogonal to the longitudinal axis L of the core shaft. For a cylindrical core shaft 20, the core shaft perimeter 26 is the circumference of the core shaft 20. Arms 10 can be supported by another machine or moveable structure that can provide movement of the arms 10 into the desired positions.

Figure 3:
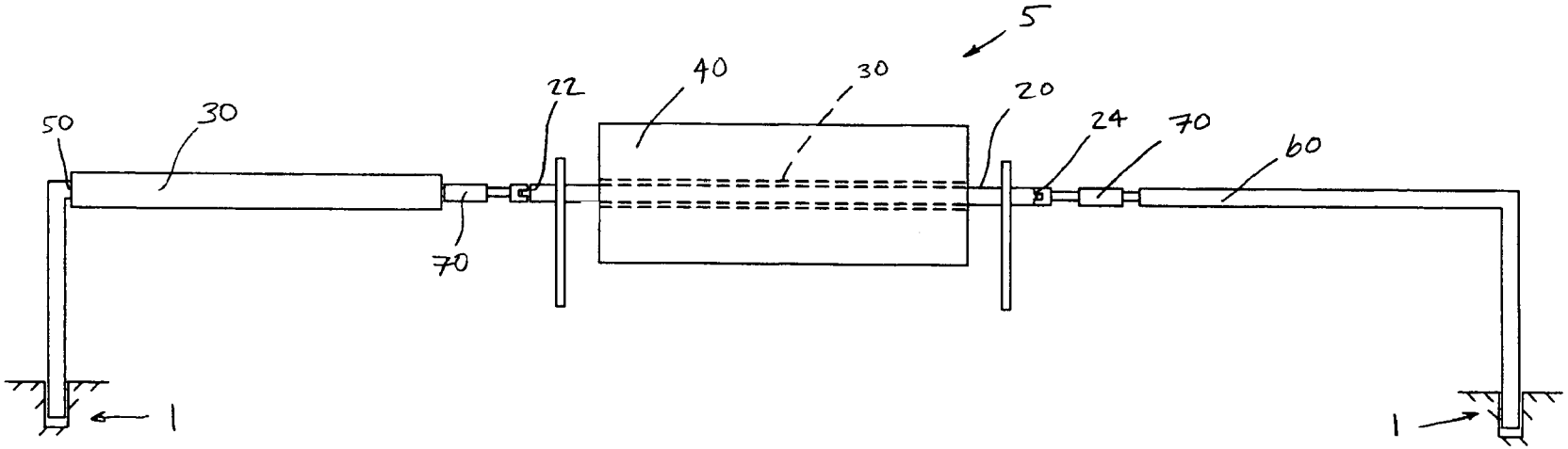
FIG. 3 is a schematic front-view of an embodiment of a roll transfer apparatus.
Figure 4:
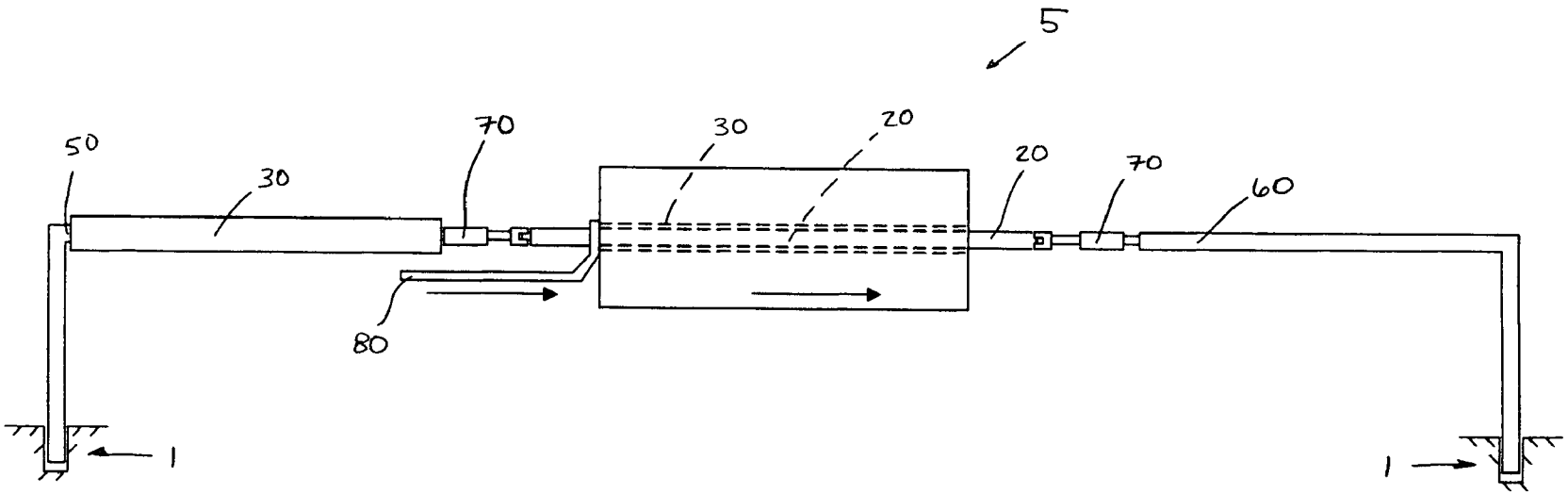
FIG. 4 is a schematic front-view of an embodiment of a roll transfer apparatus including an embodiment of a moving device.

As shown in FIG. 3, an empty first core 30 can be provided such that the empty first core 30 is coaxially related to the first axial support 50. Once the first axial support 50 is operatively engaged with the core shaft first end 22 and the second axial support 60 is operatively engaged with the core shaft second end 24, for instance, by one or more coupling units 70, the arms 10 can be separated from the core shaft 50. Once the arms 10 are removed, the core shaft 20 is axially supported at the core shaft first end 22 and core shaft second end 24, as shown in FIG. 4. An analogy to the support arrangement in FIG. 4 is a person holding a pencil by aligning the longitudinal axes of her left index and right index fingers (i.e. the longest dimension of her fingers) with the longitudinal axis of the pencil, supporting the lead end of the pencil with her left index finger by pushing her left index finger tip in towards the lead end of the pencil, and supporting the eraser end of the pencil with her right index finger by pushing her right index finger tip in towards the eraser end of the pencil. Supporting the core shaft 20 in this manner allows for the loaded first core 30 to be relatively easily moved off of the core shaft 20 and/or allow for an empty first core 30 to be easily loaded onto the core shaft 20. The portions of the first axial support 50 and second axial support 60 proximal the core shaft 20 support the core shaft 20 by providing for resistance to the bending moment applied to the first axial support 50 and second axial support 60 by the weight of the core shaft 20, loaded first core 30, and first web 40 that might be disposed thereon and providing reactive forces in the opposite direction of the weight force of the core shaft 20 and the loaded first core 30 and first web 40 that might be disposed on the core shaft 20. Axial support is to be distinguished from circumferential support in that axial support is provided from a direction in line with the longitudinal axis L of the core shaft 20 along the longitudinal axis L of the core shaft 20 whereas circumferential support is support applied in a direction orthogonal to the longitudinal axis L of the core shaft 20 to the circumference of the core shaft 20 or a portion thereof.

The approach outlined herein, can provide for simple loading and unloading of cores 30 onto and off from the core shaft 20 as compared to other approaches in which the core shaft 20 is supported proximal the core shaft first end 22 and core shaft second end 24 by structures that extend to floor of the manufacturing facility beneath the core shaft 20. When core shaft 20 is supported by structures that extend to the floor of the manufacturing facility beneath the core shaft 20, a complicated procedure of axially supporting the core shaft second end 24, removing the structure extending to the floor thereby supporting the core shaft second end 24, moving the first core 30 from the core shaft 20 to the axial support of the core shaft second end 24, replacing the structure that supports the core shaft second end 24 by extending to the floor, and decoupling the axial support of the core shaft second end 24 can be required to move a loaded first core 30 off of core shaft 20. The approach outlined herein can require fewer steps, might be able to be performed by fewer personnel, and might be able to be performed more quickly than an approach in which the core shaft 20 is circumferentially supported proximal the core shaft first end 22 and core shaft second end 24 by structures that extend to the floor of the manufacturing facility beneath the core shaft 20.

Figure 5:
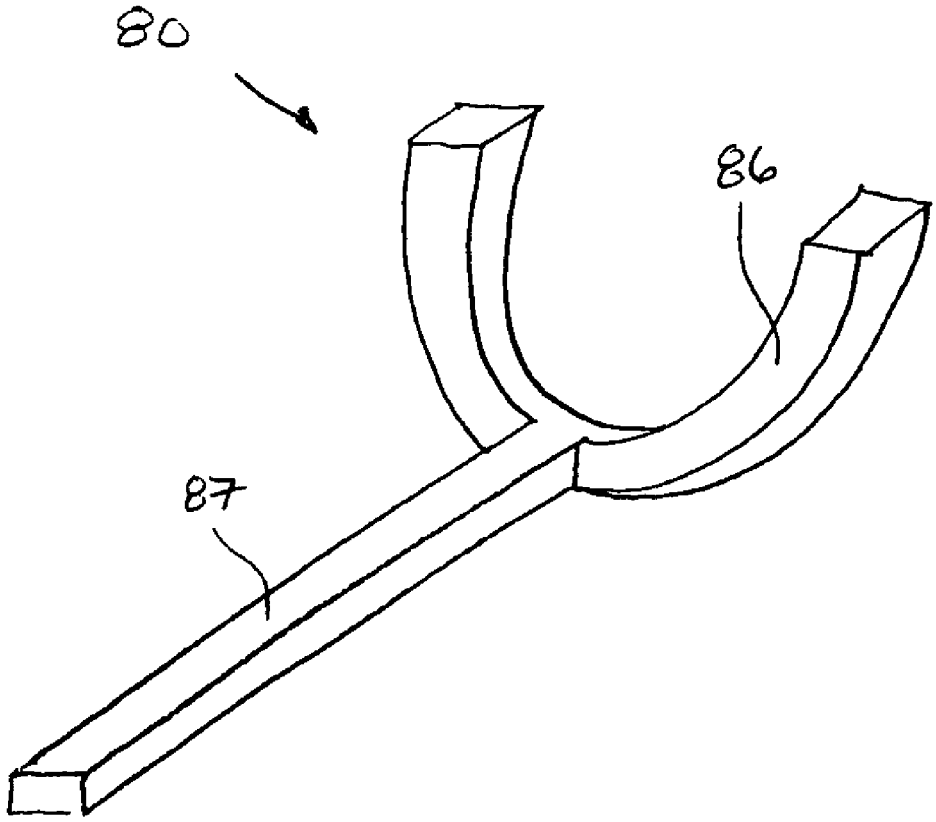
FIG. 5 is a schematic of a core moving device.

The loaded first core 30 can be moved from the core shaft 20 to the second axial support 60 by a core moving device 80. The core moving device 80 can be a structure that pushes on the loaded first core 30 to move the loaded first core 30 from the core shaft 20 to the second axial support 60. The core moving device 80 can be sized and dimensioned and configured to move the loaded first core 30 in the direction indicated by the arrow associated with the loaded first core 30 and first web 40 wound thereon by applying the majority of the applied force to the loaded first core 30 and some force to the first web 40 or applying force only to the loaded first core 30. A spacing element can be positioned between the core moving device 80 and the loaded first core 30 such that the core moving device 80 pushes on the spacing element which in turn pushes on the loaded first core. The spacing element can be helpful for pushing the loaded first core 30 over the connection between the core shaft 20 and the second axial support 60. The spacing element can be a half-cylinder that is sized and dimensioned to operatively engage with the core moving device and the loaded first core. Moving the loaded first core 30 by applying force only to the loaded core and minimizing any force applied to the first web 40 can be advantageous if the first web 40 is sensitive to applied forces. A moving device 80 that applies force to wound first web 40 could damage some types of webs 40 such as soft tissue and thin porous foams. The core moving device 80 can be moved, for example, by a motorized cart, a screw drive, or mechanical/hydraulic piston system, in the direction indicated by the arrow associated with the core moving device 80. The core moving device 80 is illustrated in FIG. 4 as being located proximal the core shaft first end 22. In that position, the moving device 80 could be used to push the loaded first core 30 from the core shaft 20 onto the second axial support 60. In another embodiment, the moving device 80 could be located proximal the core shaft second end 24. In such a position, the moving device could pull the loaded first core 30 from the core shaft 20 onto the second axial support 60. The core moving device 80 can be a cut ring 86 in operative engagement with a pushing arm 87, the cut ring 86 sized and dimensioned to engage with the loaded first core 30, as shown in FIG. 5. The cut ring 86 can be in operative engagement to a pushing arm 87 that is in operative engagement with a pushing device such as a motorize cart or suitable mechanical drive system, for example.

The second axial support 60 can have a second axial support perimeter. To ease movement of the loaded first core 30 from the core shaft 20 onto the second axial support 60, the core shaft perimeter 26 can be greater than the second axial support perimeter. The second axial support perimeter can be measured about the outer surface of the second axial support 60 orthogonal to the longitudinal axis of the second axial support 60. For a cylindrical second axial support 60, the second axial support perimeter is the circumference of the second axial support 60.

Figure 6:
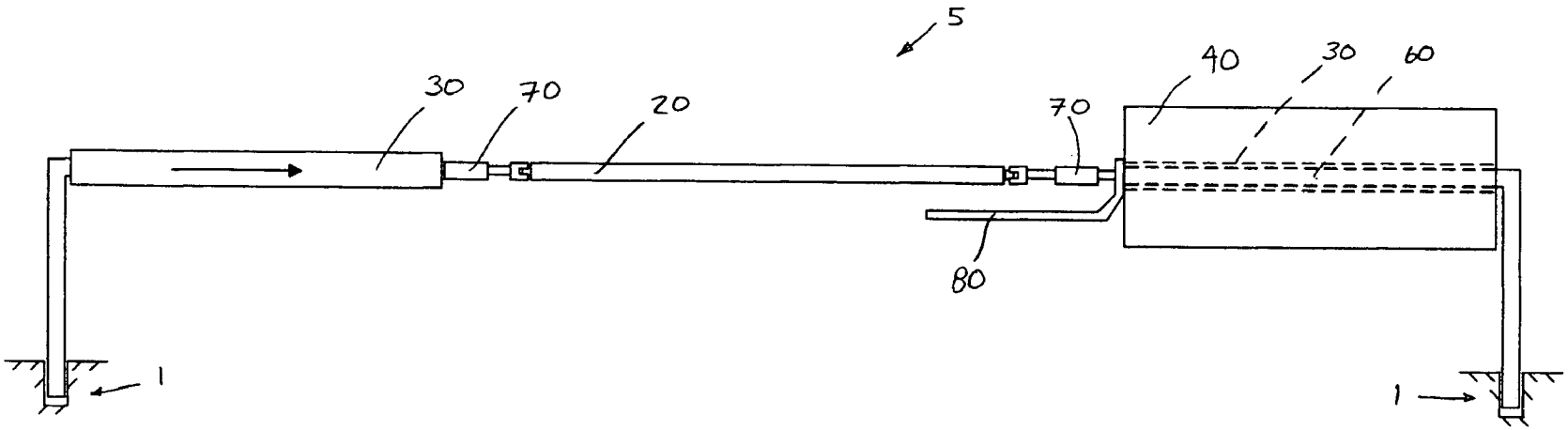
FIG. 6 is a schematic front-view of an embodiment of a roll transfer apparatus, the first core and first web wound thereon positioned on the second axial support.

Once the loaded first core 30 is removed from the core shaft 20, an empty first core 30 that is coaxially related to the first axial support 50 can be moved from the first axial support 50 onto the core shaft 20, as illustrated in FIG. 6, to a position on the core shaft 20 formerly occupied by the loaded first core 30 while the core shaft 20 is axially supported by the first axial support 50 and the second axial support 60. This readies the empty first core 30 and core shaft 20 to be positioned at the end of the production line so that an additional length of first web 40 can be wound onto the empty first core 30.

Figure 7:
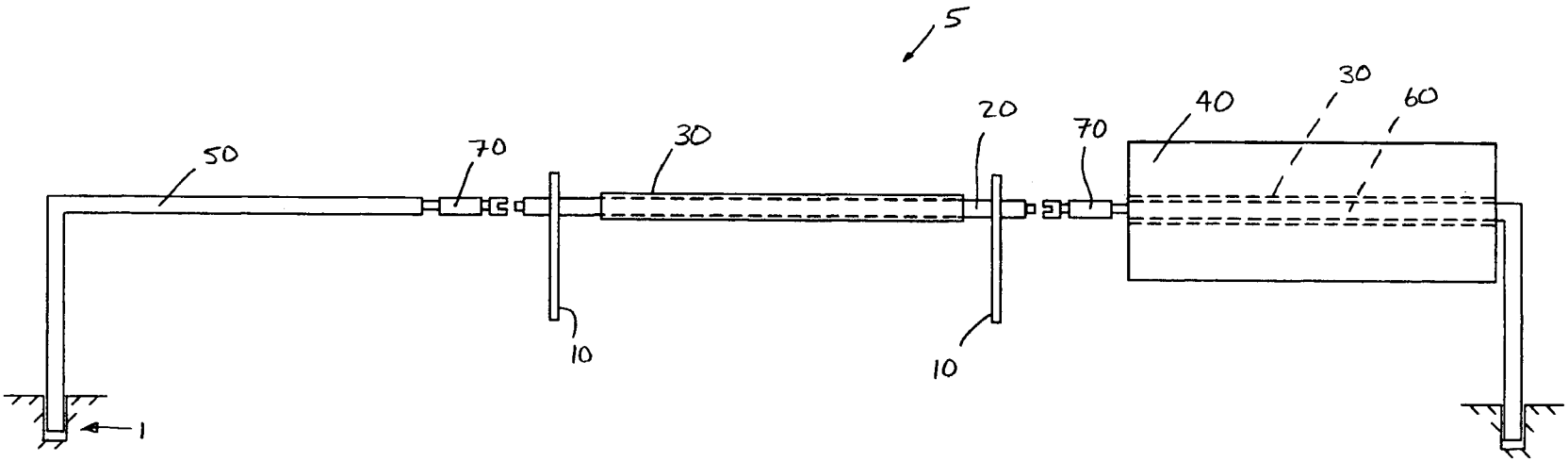
FIG. 7 is a schematic front-view of an embodiment of a roll transfer apparatus, the first core and first web wound thereon positioned on the second axial support, the first axial support and second axial support separated from the core shaft, and the lowering arms supporting the core shaft.

After the empty first core 30 is positioned on the core shaft 20, the arms 10 can be moved into position to support the core shaft proximal to the core shaft first end 22 and the core shaft second end 24. Once the core shaft 20 is supported by the arms 10, the first axial support 50 and second axial support 60 can be withdrawn from the core shaft 20, as shown in FIG. 7. The arms 10 can then move the core shaft 20 into a queue of core shafts 20 at the end of the production line ready to be put into position so that and an additional length of first web 40 can be wound onto an empty first core 30. Alternatively, a lifting table can be placed under the core shaft 20 to support the core shaft 20 then the first axial support 50 and second axial support 60 can be removed. The lifting table can be used to position the core shaft 20 into a queue of core shafts 20 at the end of the production line.

The second axial support 60 can be pivotably mounted so that the second axial support 60 can be rotated away from the space occupied by or formerly occupied by the core shaft 20. Such an arrangement can allow the loaded first core 30, loaded with the first web 40, to be removed from the second axial support 60, for instance by forklift having a spindle sized, dimensioned, and operatively located to remove the loaded first core 30 from the second axial support 60. A Knight Manipulator may be used to transfer the loaded first core 30 away from the second axial support 60. The Knight Manipulator can be designed to couple with the second axial support 60 and a presence sensing device, as described above, can be provided to one or both of the second axial support 60 and the Knight Manipulator to sense that the second axial support 60 is properly engaged with the Knight Manipulator. Similarly, first axial support 50 can be pivotably mounted so that the first axial support 50 can be rotated away from the space occupied by or formerly occupied by the core shaft 20. Such an arrangement can provide for easily loading an empty first core 30 onto the first axial support 50.

In another arrangement, the first axial support 50 can be slideably mounted so that the first axial support 50 can be moved towards and away from the core shaft first end 22. Similarly, the second axial support 60 can be slideably mounted so that the second axial support 60 can be moved towards and away from the core shaft second end 24. Such an arrangement can provide for a way to create space between the ends of the core shaft and the ends of the axial supports to allow one or both of the axial supports to be able to rotate away from the core shaft 20.

Figure 8:
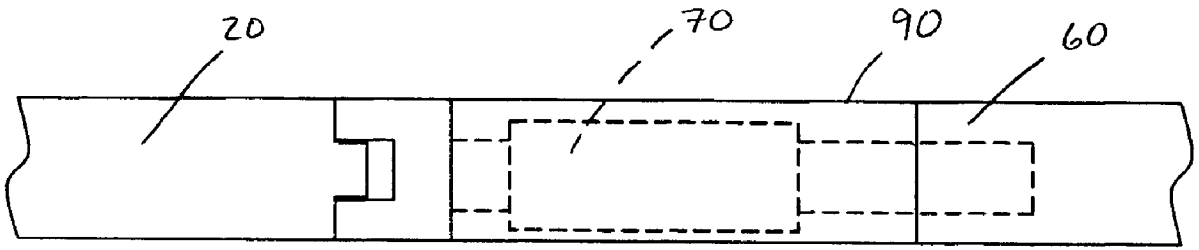
FIG. 8 is a schematic of an embodiment of a sleeve.

As shown in FIG. 8, the coupling unit 70 can be enclosed in a sleeve 90. The sleeve 90 can be sized and dimensioned to enclose or partially enclose a coupling unit 70. In one embodiment, the sleeve 90 can be a split metal or plastic hollow pipe that is separable along its length. The sleeve 90 can be sized and dimensioned to have a sleeve perimeter that is the same or less than the core shaft perimeter 26. The sleeve 90 can bridge between the core shaft 20 and an axial support. This may ease movement of the core 20 upon which a first web 40 is wound from the core shaft 20 to the second axial support 60.

The steps of a method for transferring a first web 40 wound about a loaded first core 30 can comprise providing a core shaft 20 axially extending between a core shaft first end 22 and a core shaft second end 24. Then a first web 40 wound about a loaded first core 30 can be provided, the loaded first core 30 coaxially related to the core shaft 20. Then the core shaft 20 can be axially supported by a first axial support 50 operatively engaged with the core shaft first end 22 and a second axial support 60 operatively engaged with the core shaft second end 24. The loaded first core 30 can then be axially moved from the core shaft 20 to the second axial support 60. Then the first axial support 50 and the second axial support 60 can be removed.

Figure 9:
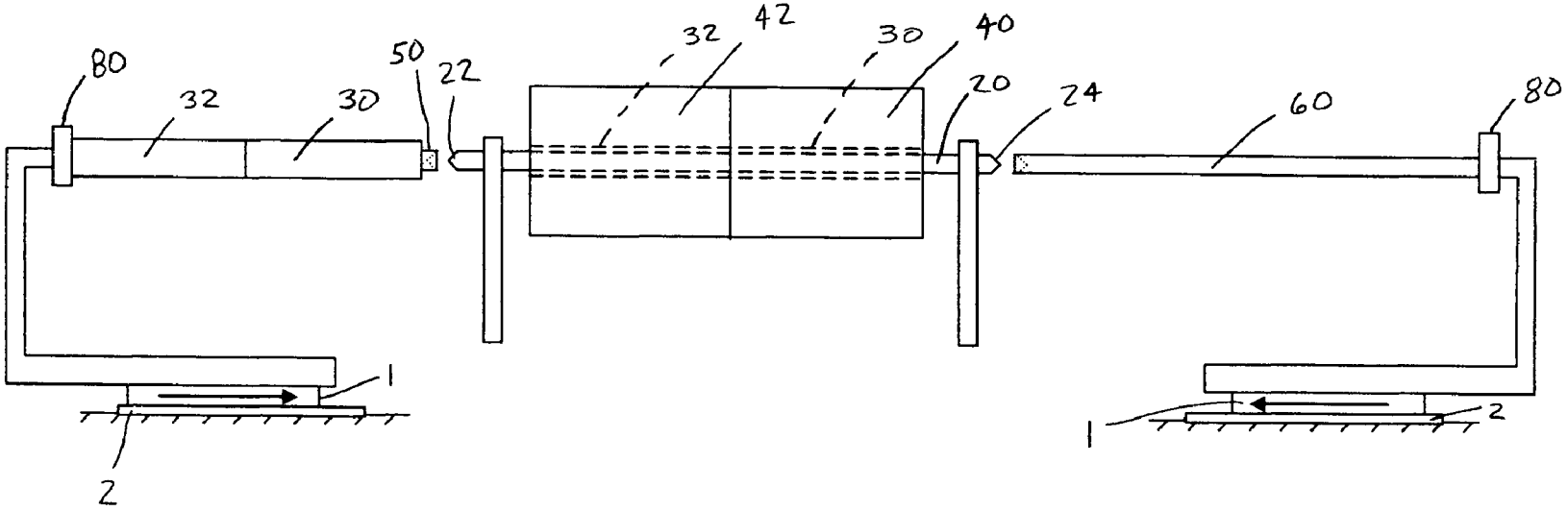
FIG. 9 is schematic front-view of an embodiment of a roll transfer apparatus.

In some applications, the web of material produced on the manufacturing line can be cut in the length direction, which is the machine direction, to provide for multiple smaller rolls of material wound upon multiples cores. Such an arrangement can provide for rolls of web material in sizes that are readily input into another manufacturing process or integrated as a component of another product on a manufacturing line. As shown in FIG. 9, the web of material can be cut along the length of the web into a plurality of webs, for instance, a first web 40 and a second web 42. First web 40 and second web 42 can be wound onto first core 30 and second core 32, respectively. In such an arrangement, a plurality of empty cores, such as an empty first core 30 and an empty second core 32, can be provided on first axial support 50. Once the loaded first core 30 and the loaded second core 32 are removed from the core shaft, empty first core 30 and empty second core 32 can be move from the first axial support 50 onto the core shaft 20 to the positions formerly occupied by the loaded first core 30 and the loaded second core 32. This readies the empty first core 30 and empty second core 32 to be placed at the end of the production line so that web material can be wound thereon.

To facilitate engagement of the first axial support 50 and second axial support 60 with the core shaft 20, the bases 1 can be translatable in a direction parallel with the longitudinal axis L of the core shaft 20, as indicated by the arrows in FIG. 9. The bases 1 can be slideably mounted to floor mounts 2 so that the first axial support 50 and second axial support 60 can be moved towards and away from the core shaft first end 22 and the core shaft second end 24, respectively. The bases 1 can be pivotably connected to the floor mounts 2 so that the first axial support 50 and second axial support 60 can be rotated towards and away from the core shaft first end 22 and the core shaft second end 24, respectively. When the first axial support 50 is rotated away from the core shaft 20, an empty core or cores, e.g. empty first core 30 and empty second core 32, can be loaded onto the first axial support 50. Once the loaded core or cores (e.g. loaded first core 30 and/or loaded second core 32) are moved onto the second axial support 60, the second axial support 60 can be translated and/or rotated away from the core shaft and the loaded core or cores, e.g. loaded first core 30 and loaded second core 32, can be removed from the second axial support 60 by hand or with the assistance of machinery.

Figure 10:
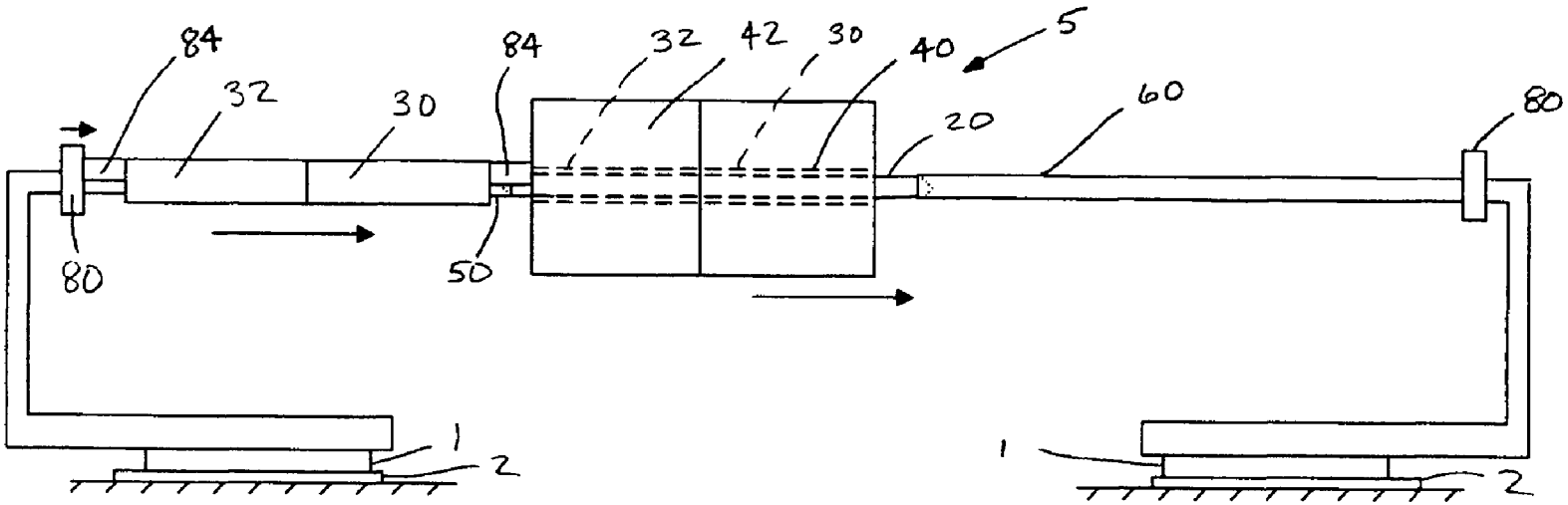
FIG. 10 is a schematic front-view of an embodiment of a roll transfer apparatus.

The moving device 80 can move the loaded core or cores off of the core shaft by pushing on empty cores that are on the first axial support 50. For example, as shown in FIG. 10, the moving device 80 can push on empty first core 30 and empty second core 32, which are on the first axial support 50. Force applied to the empty core or cores, e.g. empty first core 30 and/or empty second core 32, is translated through the empty cores to the loaded core or cores, e.g. loaded first core 30 and/or loaded second core 32, which moves the loaded cores off of the core shaft 20. To employ such an arrangement, the cores need to be made of a material strong enough to translate the force with out failing in an unacceptable manner and be sized and dimensioned relative to one another to permit translation of the force generated by the moving device 80 through the empty core or cores to the loaded core or cores. A spacing element 84 can be provided between the moving device 80 and the empty first core 30 and/or between the empty first core 30 and the loaded second core 32. The spacing element 84 can be a half-cylinder that is sized and dimensioned to operatively engage with the core moving device 80 and the empty first core 30 and/or loaded second core 32 and can be removed from the apparatus when the core shaft 20 is axially supported. The spacing element 84 should be strong and durable material, such as stainless steel, that can transmit the force required to move the loaded first core 30 and loaded second core 32 off of the core shaft 20. The spacing element 84 can have a length that is sized such that when the moving device 80 has moved out the first axial support 50 to the desired distance, the empty cores (e.g. empty first core 30 and loaded second core 32) are in the desired position on the core shaft 20.

Figure 11:
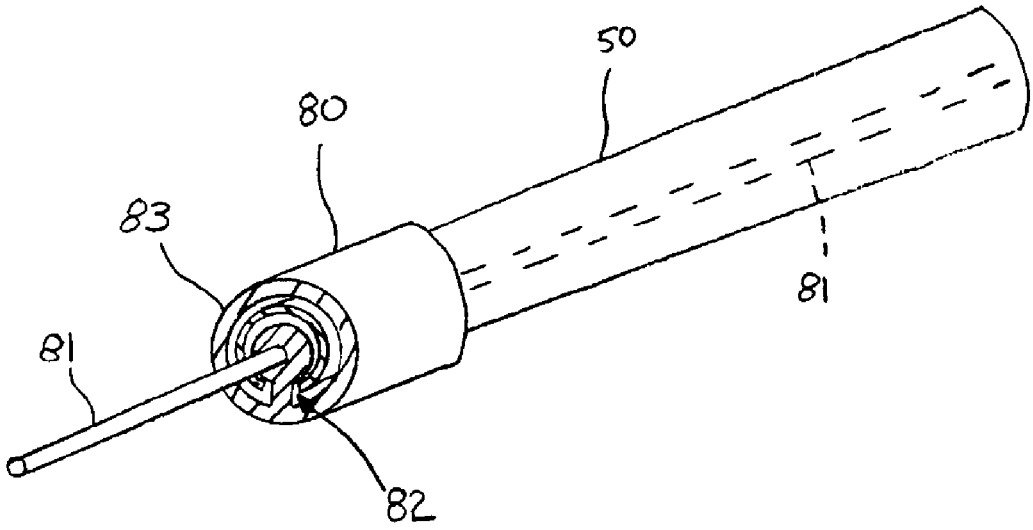
FIG. 11 is a schematic of a moving device.

The moving device 80 can be a screw driven device, with a driving screw 81 coaxially mounted within the first axial support 50, as shown in FIG. 11. The moving device 80 can be a collar 83 coaxially and slideably mounted about first axial support 50. First axial support 50 can be a slotted tube, the slot 82 providing the pathway for the collar 83 to be operatively engaged with the driving screw 81 within first axial support 50. Driving screw 81 can be driven with a motor mounted on or operatively connected to the first axial support 50. The second axial support 60 can also be provided with the same type of moving device 80 to assist with removing the loaded cores, e.g. loaded core 30 and/or loaded core 32, from the second axial support 60. In another embodiment, the moving device 80 can be a piston driven device, a piston being used in place of the driving screw 81, with the piston operatively engaged with the moving device.

Figure 12:
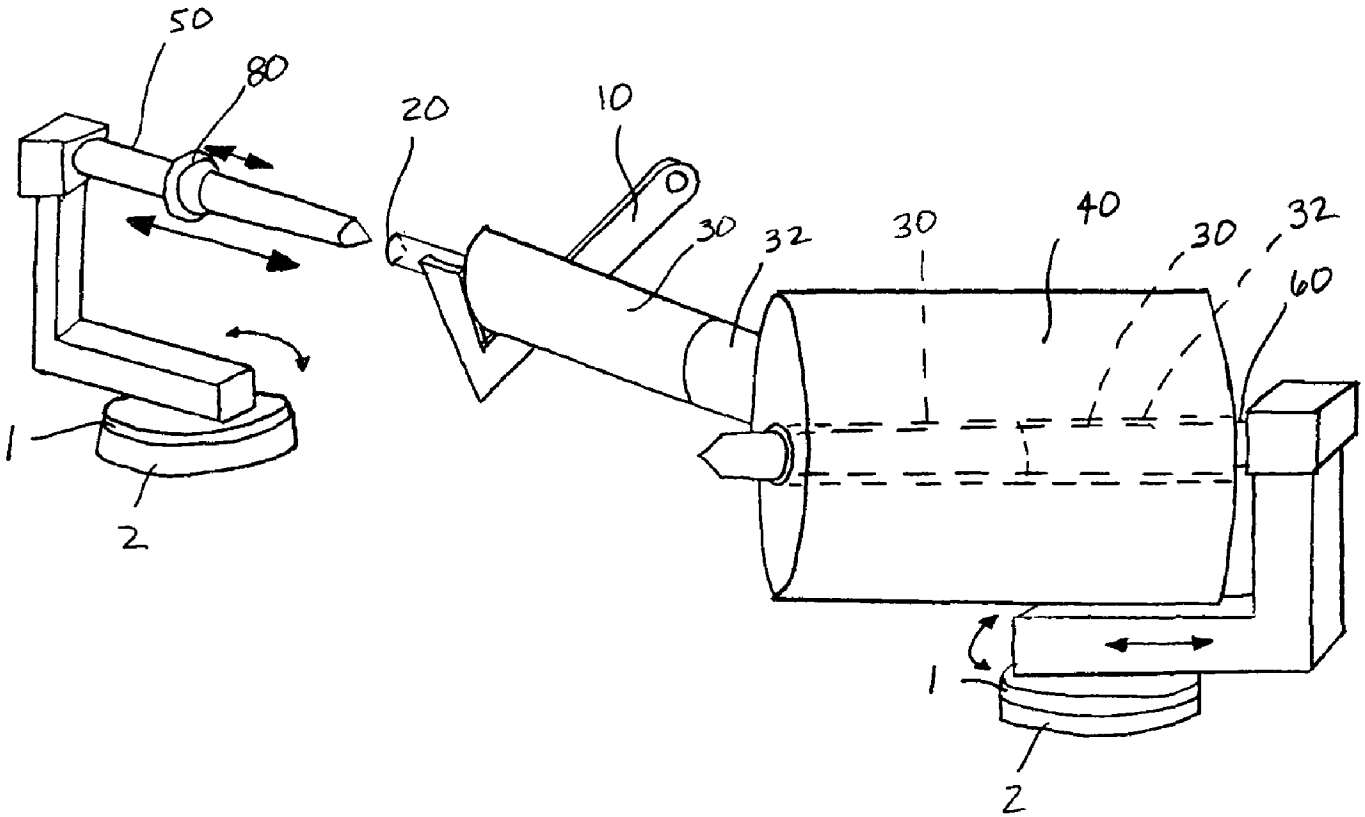
FIG. 12 is a schematic of a perspective view of a roll transfer apparatus.

FIG. 12 is a schematic of a roll transfer apparatus 5 in operation after a loaded first core 30 and a loaded second core 32 have been pushed off of the core shaft 20. In the position shown, empty first core 30 and empty second core 32 are on the core shaft 20 and the core shaft 20 is supported by arms 10. From this position, the core shaft 20 can be moved into a queue so as to be ready for web material to be wound thereon. The second axial support 60 is rotated away from the core shaft 20 so that loaded first core 30 and loaded second core 32 can be moved off of the second axial support 60. First axial support 50 can be rotated from the position shown to allow an empty core or cores to be loaded thereon conveniently.

Figure 13:
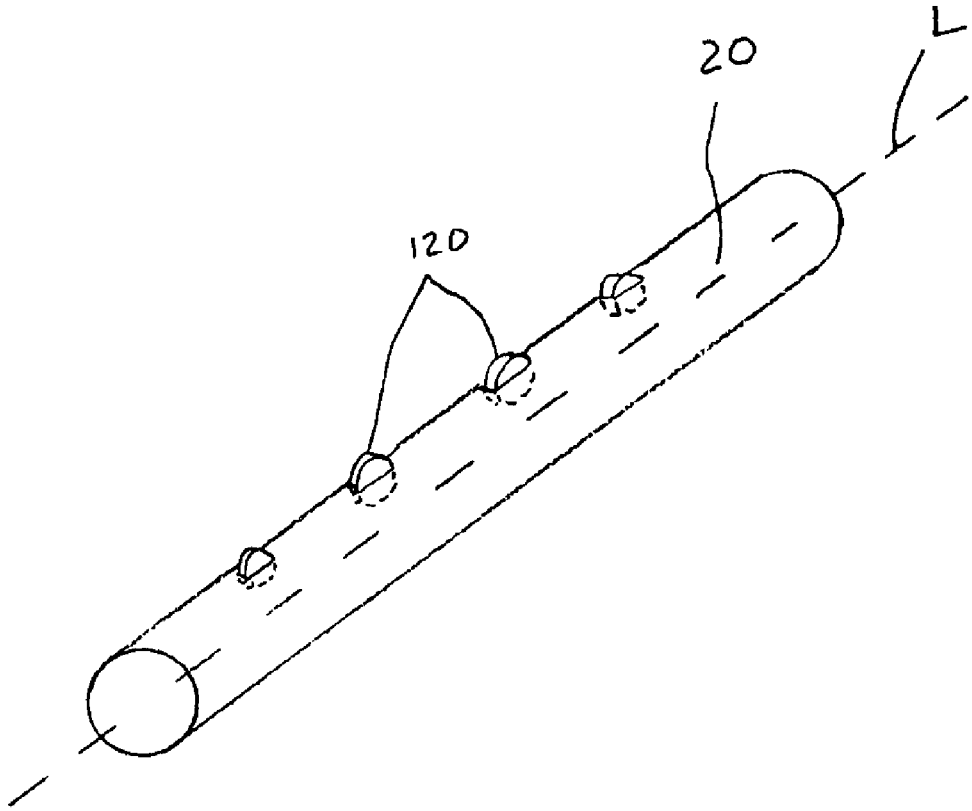
FIG. 13 is a schematic of core shaft comprising rollers.

As shown in FIG. 13, the core shaft 20 can comprise a line of rollers 120 along the length of the core shaft 20 to support the core and to make it easier to slide a loaded core off of the core shaft 20. The apparatus can be operated such that when a loaded core is being moved off of the core shaft 20, the rollers 120 on the core shaft are oriented upwards (e.g. in the opposite direction from the force of gravity) so that the rollers 120 at least partially support the load of a loaded core and the loaded core can easily roll along the rollers 120. The rollers 120 can be small wheels that are partially embedded and mounted to core shaft 20. The rollers 120 can be roller bearings partially embedded and mounted to the core shaft 20.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for transferring a web wound about a loaded core comprising the steps of:

providing a core shaft axially extending between a core shaft first end and a core shaft second end;

providing a first web wound about a loaded first core, said loaded first core coaxially related to said core shaft;

axially supporting said core shaft by a first axial support operatively engaged with said core shaft first end and a second axial support operatively engaged with said core shaft second end;

axially moving said loaded first core from said core shaft to said second axial support;

removing said first axial support and said second axial support; and providing a first empty core coaxially related to said first axial support and moving said first empty core from said first axial support to said core shaft to a position on said core shaft formerly occupied by said loaded first core while said core shaft is axially supported by said first axial support and said second axial support.

2. The method of claim 1, wherein the step of axially moving said loaded first core from said core shaft to said second axial support is conducted by pushing on said loaded first core.

3. The method of claim 1, wherein the step of axially moving said loaded first core from said core shaft to said second axial support is conducted by pushing on said loaded first core with an empty first core.

4. The method of claim 1, wherein said second axial support is operatively engaged with said core shaft by a coupling unit sized and dimensioned and operatively positioned to connect said second axial support to said core shaft.

5. The method of claim 1, wherein said core shaft has a core shaft perimeter and said second axial support has a second axial support perimeter, wherein said core shaft perimeter is greater than or equal to said second axial support perimeter.

6. The method of claim 1, wherein a portion of said second axial support or a portion of said first axial support is nested coaxially within said core shaft.

7. The method of claim 1, wherein a portion of said core shaft is coaxially nested within one of said first axial support and said second axial support.

8. The method of claim 1, wherein said second axial support is pivotably mounted so that said second axial support can be rotated towards and away from said core shaft.

9. The method of claim 1, wherein said core shaft second end is operatively engaged with said second axial support by an axially expandable coupling unit.

10. The method of claim 9, wherein said axially expandable coupling unit is attached to said core shaft.

11. The method of claim 9, wherein said axially expandable coupling unit is attached to said second axial support.

12. The method of claim 9, wherein said expandable coupling unit is provided with a sleeve having a sleeve perimeter, wherein said core shaft has a core shaft perimeter, wherein said sleeve perimeter is about the same or less than said core shaft perimeter.

13. The method of claim 1, further comprising the steps of providing a second web wound about a loaded second core, said loaded second core coaxially related to said core shaft and axially moving said loaded second core from said core shaft to said second axial support.

* * * * *